United States Patent [19]

Feuerstein

[11] 4,341,314

[45] Jul. 27, 1982

[54] CONTAINER STOP DEVICE FOR REFRIGERATOR TRAYS

[76] Inventor: Richard E. Feuerstein, 3857 Van Dyke, White Bear Lake, Minn. 55110

[21] Appl. No.: 160,008

[22] Filed: Jun. 16, 1980

[51] Int. Cl.[3] ..... A47F 5/00

[52] U.S. Cl. ..... 211/184; 248/222.3

[58] Field of Search ..... 211/184, 86, 49 S, 106, 211/134, 153, 181; 108/61; 119/18; 248/222.2, 222.3

[56] References Cited

U.S. PATENT DOCUMENTS

| | | | |
|---|---|---|---|
| 1,239,151 | 9/1917 | Woods | 248/222.3 X |
| 2,280,371 | 4/1942 | Bishop | 211/184 |
| 3,091,348 | 5/1963 | Neuhauser | 211/49 S X |
| 3,119,372 | 1/1964 | Gantz | 119/18 |
| 3,255,987 | 6/1966 | Gatch | 211/184 X |
| 4,023,682 | 5/1977 | Niece | 211/184 |

*Primary Examiner*—Roy D. Frazier
*Assistant Examiner*—Robert W. Gibson, Jr.
*Attorney, Agent, or Firm*—Williamson, Bains, Moore & Hansen

[57] ABSTRACT

An upright stop member having a container contact surface on at least one of its opposed side walls for holding containers in place on a refrigerator shelf. The stop member may be removably secured in place between a pair of spaced apart, parallel rods of a refrigerator shelf by means of a pair of aligned recesses on the opposed side walls of the stop member which are laterally spaced apart a predetermined distance so as to receive a pair of refrigerator shelf rods in snug, frictional engagement therewith. Lowermost side wall segments of the stop member side walls extend below the aforesaid recesses and are spaced apart by a predetermined width greater than the lateral spacing between the recesses and between the adjacent rods of a refrigerator shelf. With the stop member in place, the lowermost side wall segments will extend downwardly below the pair of refrigerator shelf rods with which the stop member is engaged and be retained below the rods to assist in holding the stop member in place.

8 Claims, 6 Drawing Figures

CONTAINER STOP DEVICE FOR REFRIGERATOR TRAYS

BACKGROUND OF THE INVENTION

Various types of dividers and stop devices are known for use in combination with refrigerator shelves to space and restrain articles on such shelves. U.S. Pat. No. 2,280,371 discloses an adjustable guide plate for refrigerator shelves, and a retainer plate which can be snapped on to the cross rods of a refrigerator shelf is shown in U.S. Pat. No. 3,851,765. Reference is also made to U.S. Pat. No. 4,023,682 which discloses a retaining device made of spring wire which may be clipped on to the spaced apart rods of a refrigerator shelf.

The pertinent prior art as reflected in U.S. Pat. No. 3,255,987 also includes a plastic pin device having a crossbar on its lower end spaced from a flange disc in such a way as to permit the device to be secured in place through an aperture in a base panel with the crossbar engaging the underside of the panel. Stacking or restraining devices having inclined surfaces for restraining engagement with round articles are also known. See U.S. Pat. No. 3,091,348.

The stop device disclosed herein has been developed with a view towards providing a small, upright stop member which can be easily secured in place on a refrigerator shelf for restraining engagement with containers thereon in a manner not provided by the aforesaid prior art.

BRIEF SUMMARY OF THE INVENTION

This invention is directed to a stop device so constructed and sized that it may be easily and inexpensively produced as a molded plastic item for quick and easy removable locking engagement between the spaced-apart, parallel rods of a refrigerator shelf, and thereby serve effectively as a container spacing and restraining device.

These basic objectives are realized by forming the stop device as an upright member having opposed side walls which may serve as container contact surfaces, and a pair of elongated, aligned recesses in the side walls which are sized, shaped and located so as to be removably engagable with the adjacent surfaces of a pair of parallel, laterally spaced rods of a refrigerator shelf in snug engagement therewith.

Advantageously, the aforesaid elongated recesses are laterally spaced apart a predetermined distance corresponding to the distance between the adjacent surfaces of a pair of parallel, laterally spaced rods of a refrigerator shelf. Each of the side walls of the stop member has a lowermost side wall segment which extends below the aforesaid recesses. These side wall segments are spaced apart by a predetermined width which is greater than the lateral spacing between the recesses and greater than the distance between a pair of parallel, laterally spaced rods of a refrigerator shelf. Thus, with the stop device positioned between a pair of such parallel rods of a refrigerator shelf, the lowermost side wall segments may be vertically located so as to extend downwardly between the pair of rods to a position therebelow to secure the stop device against vertical displacement with the pair of shelf rods firmly engaged within the aligned recesses in the side walls of the stop member. Preferably, the aforesaid recesses are of arcuate shape conforming to the arcuate shape of the round rods of a refrigerator shelf to thereby ensure snug, close-fitting engagement therewith.

Ease of attachment of the stop device to a refrigerator shelf having parallel, spaced-apart rods is ensured by providing a front to back depth dimension of the stop member side walls which is less than the distance between the adjacent surfaces of a pair of parallel rods of a refrigerator shelf. This permits the stop member to be inserted between a pair of parallel rods of such a refrigerator shelf, and then rotated to bring the aforesaid recesses into substantially parallel, snug-fitting engagement with the pair of rods.

As a further advantageous feature of the stop device, the upper portions of the side walls thereof are preferably inclined inwardly towards each other at a predetermined angle so as to intersect at an apex. These inclined top portions of the side walls of the stop device form container contact surfaces particularly effective in restraining round containers, such as soft drink cans and bottles, against rolling movement.

These and other objects and advantages of the stop device disclosed herein will become readily apparent as the following description is read in conjunction with the accompanying drawings wherein like reference numerals have been used to designate like elements throughout the several views.

DESCRIPTION OF THE PREFERRED EMBODIMENTS

Figure 2:
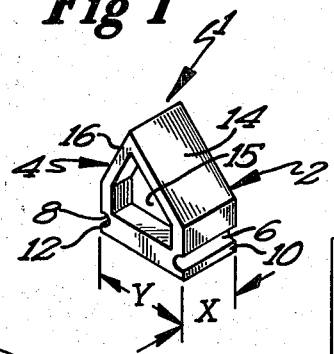
FIG. 2 is a perspective view of one preferred embodiment of the stop device.
Figure 3:
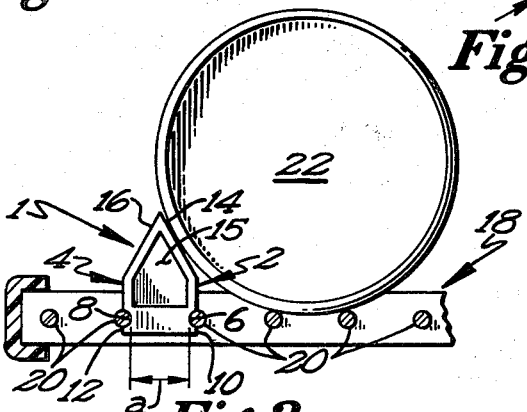
FIG. 3 is a fragmentary, front elevation view showing the stop device of FIG. 2 in position on a refrigerator shelf.

Referring now to the drawings, I have shown in FIG. 2 a preferred embodiment of the stop device generally indicated by reference numeral 1. The stop device 1 has opposed side walls 2 and 4 of sufficient height to provide a generally upright stop member when oriented in its position of use. Side walls 2 and 4 are formed adjacent their lower ends to provide a pair of elongated recesses 6 and 8 which are in substantially horizontal alignment. Extending below recesses 6 and 8 on each of the side walls 2 and 4 are lowermost side wall segments 10 and 12. Preferably, for the purpose of restraining engagement with round containers as shown in FIG. 3, each of the opposed side walls 2 and 4 is formed at its upper end to provide top portions 14 and 16 which incline inwardly towards each other at a predetermined angle and intersect at an apex to provide a generally triangular shaped stop device at its upper portion. Inclined side wall portions 14 and 16 provide container contact surfaces.

Although the stop device of FIG. 2 may be formed from different materials in various ways, I have found that such a device may be manufactured in a particularly simple and inexpensive way be molding it as a unitary piece from plastic.

FIG. 3 illustrates the stop device 1 of FIG. 2 affixed to a refrigerator shelf 18. Shelf 18 is of well known construction comprised of a plurality of parallel, laterally-spaced rods 20. For ease of engagement with a pair of spaced-apart shelf rods 20, stop device 1 is preferably sized so that side walls 2 and 4 have a front to back depth dimension "x" which is less than the distance "a" between the adjacent surfaces of a pair of shelf rods 20 as shown in FIG. 3. This permits stop device 1 to be inserted between a pair of parallel rods 20 of the refrigerator shelf with recesses 6 and 8 extending generally perpendicular to the shelf rods 20. Thereafter, stop device 1 may be rotated to bring recesses 6 and 8 into substantially parallel, snug-fitting engagement with a pair of parallel rods 20 as shown in FIG. 3. Such snug-fitting engagement to lock stop device 1 in place between a pair of rods 20 is ensured by forming and locating recesses 6 and 8 so that they are laterally spaced apart a predetermined distance which substantially corresponds to the distance "a" between the adjacent surfaces of a pair of rods 20.

With the stop device 1 secured in place shown in FIG. 3 with a pair of rods 20 in snug, frictional engagement with elongated recesses 6 and 8, lowermost side wall segments 10 and 12 will extend downwardly between the pair of shelf rods 20 to a position therebelow. Since lowermost side wall segments 10 and 12 are spaced apart by a predetermined width which is greater than the lateral spacing between recesses 6 and 8 and greater than the distance "a" between the adjacent surfaces of a pair of parallel rods 20, lowermost side wall segments 10 and 12 will be positioned adjacent the underside of rods 20 and therefore assist in securing stop device 1 against vertical displacement. From the foregoing, it will be understood that depth dimension "x" of the side walls 2 and 4 is less than the width dimension "y" of stop device 1 between lowermost side wall segments 10 and 12.

It is also to be noted with respect to FIGS. 2 and 3 that elongated recesses 6 and 8 are formed to an arcuate configuration generally conforming to the arcuate shape of round shelf rods 20. This provides a particularly snug and secure locking engagement of shelf rods 20 within recesses 6 and 8.

Figure 1:
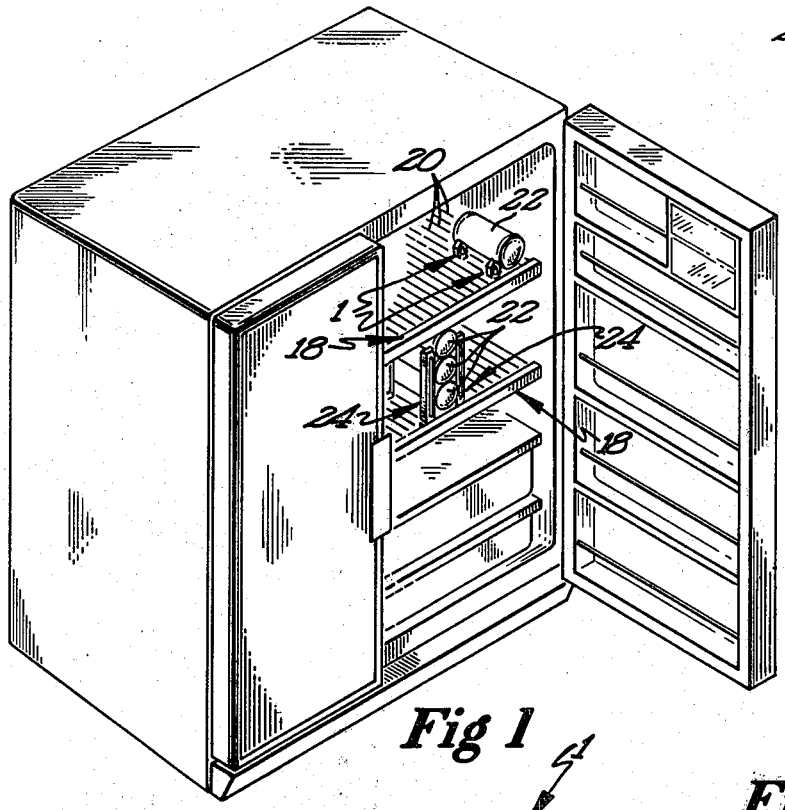
FIG. 1 is a perspective view of a refrigerator showing the stop devices of this invention in use on refrigerator shelves.

FIG. 3 further illustrates the manner in which stop device 1 may be effectively utilized to hold a round container 22 in place on refrigerator shelf 18. Such a round container may comprise, for example, a soft drink can lying on its side. Top portions 14 and 16 of stop device side walls 2 and 4 are inclined at a predetermined angle so as to provide substantially tangential contact with the curvilinear wall of a round container 22 in restraining engagement therewith as shown in FIG. 3. FIG. 1 illustrates a pair of stop devices 1 secured in place on a refrigerator shelf 18 so as to engage a round container 22 at spaced points along its length, and hold a plurality of such containers in place against rolling displacement. Containers 22 may be of the type commonly employed for beer and soft drinks.

The small size of stop device 1 is readily discernible by comparison with that of containers 22. Preferably, stop devices 1 will be sized so that the overall height will be between 1 and 2 inches. Dimension "x" will be on the order of one-half inch to permit the device to be readily inserted between the closely spaced bars of a refrigerator shelf, and dimension "y" will be approximately three quarters of an inch.

Figure 4:
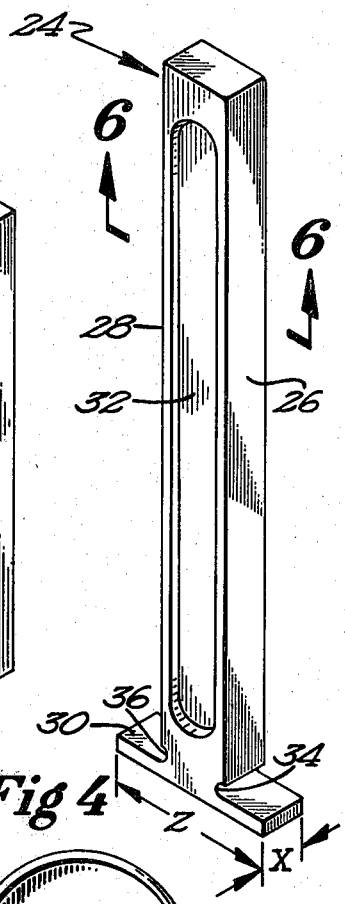
FIG. 4 is a perspective view of an alternative embodiment of the stop device.
Figure 6:
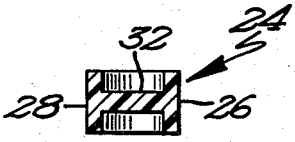
FIG. 6 is a section view of the stop device of FIG. 4 taken along line 6—6 thereof.
Figure 5:
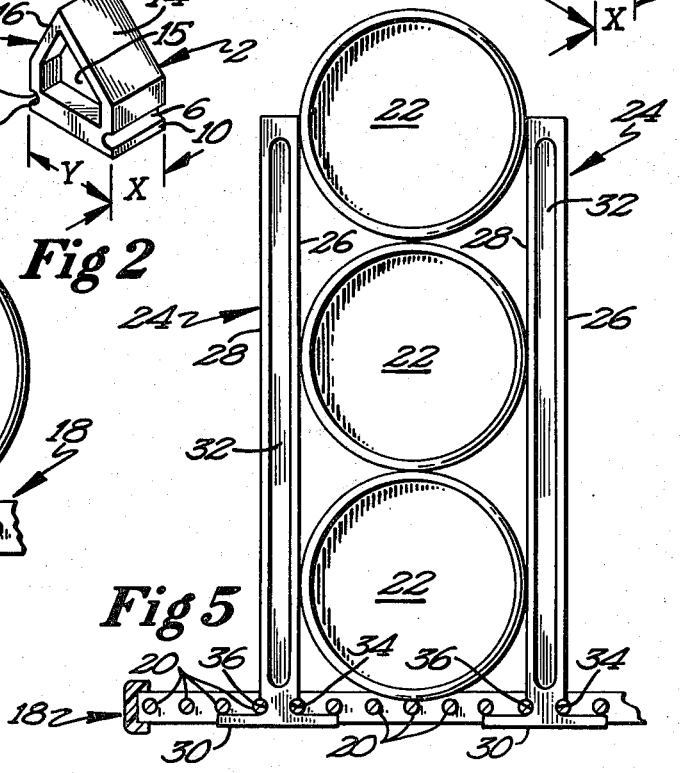
FIG. 5 is a front, elevation view showing two of the stop devices of FIG. 4 in position to restrain containers on a refrigerator shelf.

FIGS. 4, 5, and 6 illustrate an alternative embodiment of the stop device which is vertically elongated to provide a height considerably greater than that of stop device 1. Such a stop device is generally indicated by reference numeral 24, and is comprised of vertically elongated side walls 26 and 28 terminating at their bottom ends at a relatively shorter base segment 30. Stop device 24 thus assumes a generally inverted, T-shaped configuration. Stop device 24 is also preferably molded from plastic and has a vertically extending central web 32 between elongated side walls 26 and 28 to provide the H-shaped cross section as illustrated in FIG. 6. This particular cross section lends strength to the elongated stop device 24. Side walls 26 and 28 have a front to back depth dimension "x" which is less than the distance "a" between adjacent rods 20 of refrigerator shelf 18 and which is preferably identical to dimension "x" of stop device 1. Base segment 30 has a length dimension "z" which is greater than the distance "a" between a pair of adjacent parallel shelf rods 20. Preferably, base segment 30 is of sufficient longitudinal extent so as to span a plurality of such parallel rods 20 when extending perpendicular thereto as shown in FIG. 5. Base segment 30 is located immediately below elongated recesses 34 and 36 formed in side walls 26 and 28 at the bottom ends thereof. Recesses 34 and 36 are also preferably in arcuate configuration for conforming contact with round shelf rods 20.

Stop device 24 may be inserted between a pair of shelf rods 20 by initially orienting it so that side walls 26 and 28 and arcuate recesses 34 and 36 extend generally perpendicular to shelf rods 20. With stop device 24 so positioned, and with base segment 30 below shelf rods 20, the device 24 is then rotated to bring recesses 34 and 36 into substantially parallel, snug-fitting engagement with rods 20 as illustrated in FIG. 5. This will bring base segments 30 into their locking positions of use in engagement with the underside of a plurality of shelf rods 20. Base segments 30 thereby cooperate with elongated recesses 34 and 36 to secure vertically elongated stop devices 24 against horizontal and vertical displacement as well as against tipping action which might be caused by a high vertical load bearing against stop devices 24. FIG. 5 illustrates such a high vertical load in the form of a plurality of stacked, round containers 22 of the type discussed above. Both FIG. 1 and FIG. 5 illustrate a plurality of the vertically elongated stop devices 24 being utilized to contain a stack of round containers 22 on a refrigerator shelf 18. For such purposes stop devices 24 would be utilized in cooperation in restraining contact with the opposite sides of round containers 22 in a stack as shown.

It is to be noted that the stop device 1 of FIGS. 2 and 3 may also be formed with a vertically extending web 15 extending between side walls 2 and 4. It is anticipated that various changes may be made in the size, shape, and structure of the stop devices for refrigerator shelves as disclosed herein without departing from the spirit and scope of the invention as defined by the following claims.

What is claimed is:

1. In combination with a refrigerator tray comprised of a plurality of parallel, laterally spaced rods, a stop device for restraining containers from movement on said tray comprising:

an upright stop member of sufficient height to bear against containers to be held in place, said stop member having opposed side walls;

a container contact surface on at least one of said opposed side walls of said stop member adapted to bear against stored containers said container contact surface being inclined at a predetermined angle to provide substantially tangential contact with the curvilinear side walls of a round container and thereby preventing rolling displacement of such a container on the refrigerator shelf;

an elongated recess in each of said opposed side walls of said stop member, said recesses being in horizontal alignment with each other and sized to receive the rods of said refrigerator shelf in snug engagement therewith, and said recesses being laterally spaced apart a predetermined distance substantially corresponding to the distance between the adjacent surfaces of a pair of parallel, laterally spaced rods of said refrigerator shelf, and said stop member being positioned between a pair of such shelf rods and locked in place with said pair of rods in snug, frictional engagement within said recesses; and each of said side walls having a lowermost side wall segment extending below said recesses, said lowermost side wall segments being spaced apart by a predetermined width greater than the lateral spacing between said recesses and greater than said distance between the adjacent surfaces of said pair of parallel, laterally spaced rods of the refrigerator shelf, and said lowermost side wall segments extending downwardly between said pair of said refrigerator shelf rods to a position therebelow and retained below said rods with said rods engaged within said recesses to assist in holding said stop member in place.

2. The combination of a refrigerator tray and a stop device as defined in claim 1 wherein:

said laterally spaced rods of said refrigerator shelf are round in cross section and said elongated recesses are of arcuate shape conforming to the round shape of said rods for snug engagement therewith.

3. The combination of a refrigerator tray and a stop device as defined in claim 2 wherein:

the top portions of each of said opposed side walls of said stop member incline inwardly towards each other at a predetermined angle and intersect at an apex, each of said inclined top portions of said side walls forming container contact surfaces angled to provide substantially tangential contact with the curvilinear side walls of a round container and thereby prevent rolling displacement of such containers on said refrigerator shelf.

4. A stop device for holding containers in place on refrigerator shelves comprising:

an upright stop member of sufficient height to bear against containers to be held in place, said stop member having opposed side walls;

a container contact surface on at least one of said opposed side walls of said stop member adapted to bear against stored containers, said container contact surface being inclined at a predetermined angle to provide substantially tangential contact with the curvilinear side walls of a round container and thereby preventing rolling displacement of such a container on the refrigerator shelf;

an elongated, arcuate recess in each of said opposed side walls of said stop member conforming to the arcuate shape of spaced-apart rods of a refrigerator shelf, said recesses being in alignment and size to receive such rods of a refrigerator shelf in snug engagement therewith, and said recesses being laterally spaced apart a predetermined distance substantially corresponding to the distance between the adjacent surfaces of a pair of parallel, laterally spaced rods of a refrigerator shelf;

a lowermost side wall segment extending below said recesses on each of said side walls, said lowermost side wall segments being spaced apart by a predetermined width greater than the lateral spacing between said recesses, whereby said lowermost side wall segments may be extended downwardly between a pair of said refrigerator shelf rods to a position therebelow and retained below said rods with said rods engaged within said recesses to assist in holding said stop member in place; and said side walls of said stop member having a front to back depth dimension which is less than the distance between the adjacent surfaces of a pair of parallel rods of a refrigerator shelf and less than said predetermined width between said lowermost side wall segments, whereby said stop member may be inserted between a pair of parallel rods of a refrigerator shelf with said recesses extending generally perpendicular to said shelf rods and then rotated to bring said recesses into substantially parallel, snug-fitting engagement with said pair of rods.

5. A stop device as defined in claim 4 wherein:

the top portions of each of said opposed side walls of said stop member incline inwardly towards each other at a predetermined angle and intersect at an apex, each of said inclined top portions of said side walls forming container contact surfaces.

6. A stop device as defined in claim 5 wherein:

said stop device is molded as a unitary piece from plastic.

7. A stop device as defined in claim 5 wherein:

said stop device is formed as a unitary structure from a single piece of material.

8. A stop device as defined in claim 7 wherein:

each of said side walls further includes a lower, substantially vertically extending portion above said recesses intersecting the bottom end of said inclined top portions, and said lowermost side wall segments being in vertical alignment with said vertically extending side wall portions above said recesses.

* * * * *